United States Patent [19]

Färlind

[11] 3,975,800

[45] Aug. 24, 1976

[54] BELT STRAP ADJUSTING DEVICES

[75] Inventor: Stig Axel Göran Färlind, Monsteras, Sweden

[73] Assignee: Stece - AB Industrifjadrar, Monsteras, Sweden

[22] Filed: Feb. 14, 1975

[21] Appl. No.: 550,027

[30] Foreign Application Priority Data

Feb. 27, 1974 Sweden ..... 7402582

[52] U.S. Cl. ..... 24/196

[51] Int. Cl.[2] ..... A44B 11/10

[58] Field of Search ..... 24/196

[56] References Cited

UNITED STATES PATENTS

| | | | |
|---|---|---|---|
| 3,162,915 | 12/1964 | Rosenberg | 24/196 |
| 3,317,970 | 5/1967 | Van Noord | 24/196 |
| 3,496,615 | 2/1970 | Krengel | 24/196 |
| 3,725,982 | 4/1973 | Fisher | 24/196 |

FOREIGN PATENTS OR APPLICATIONS

| | | | |
|---|---|---|---|
| 1,449,242 | 7/1966 | France | 24/196 |
| 1,388,999 | 1/1965 | France | 24/196 |
| 223,888 | 12/1968 | Sweden | 24/196 |
| 301,277 | 5/1968 | Sweden | 24/196 |
| 1,153,953 | 6/1969 | United Kingdom | 24/196 |
| 939,631 | 10/1963 | United Kingdom | 24/196 |

*Primary Examiner*—Bernard A. Gelak
*Attorney, Agent, or Firm*—Karl W. Flocks

[57] ABSTRACT

A device for adjusting a strap of a safety belt for vehicles and like craft comprises a latch in the form of a bar which is transversely movable with respect to a base plate. The base plate is formed with an opening through which the strap is passed about the bar for clamping the strap between the bar and the base plate when the strap is subjected to pull. At a heavy pull at the strap, the bar is adapted to be shifted laterally of the opening in the direction of pull. Between the base plate and the bar the device has a thin flat member which is associated with the base plate and adapted, at a heavy pull at the strap, to be carried along by the bar when the latter is shifted laterally of the opening. At said shifting movement the flat member lies between the strap and the base plate so that the strap is protected against abrasion under the heavy load.

4 Claims, 5 Drawing Figures

BELT STRAP ADJUSTING DEVICES

The invention relates to a device for adjusting a strap of a safety belt for vehicles and like craft, said device being a latch in the form of a bar which is transversely movable with respect to a base plate formed with an opening which is associated with the bar and through which the strap is passed about the bar for clamping the strap between the bar and the base plate when the strap is subjected to pull, said bar being adapted at a heavy pull at the strap, to be shifted laterally of the opening in the direction of pull.

According to the invention the belt strap adjusting device has between the base plate and the bar a thin flat member which is associated with the base plate and adapted, at a heavy pull at the strap, to be carried along by the bar when the latter is shifted laterally of the opening, said flat member lying at said shifting movement between the strap and the base plate so that the strap is protected against abrasion under the heavy load. The invention thus provides a strap adjusting device for safety belts, which satisfies very high requirements for statical and dynamical strength and abrasion resistance with respect to the strap.

An embodiment of the invention will be more fully described hereinbelow and with reference to the accompanying drawing, in which.

Figure 1:
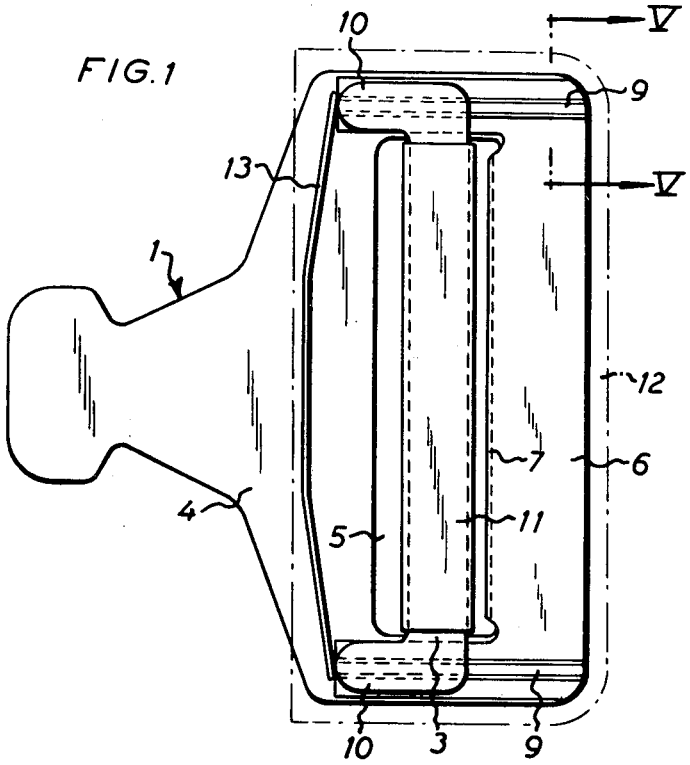
FIG. 1 is a plan view of the device.
Figure 2:
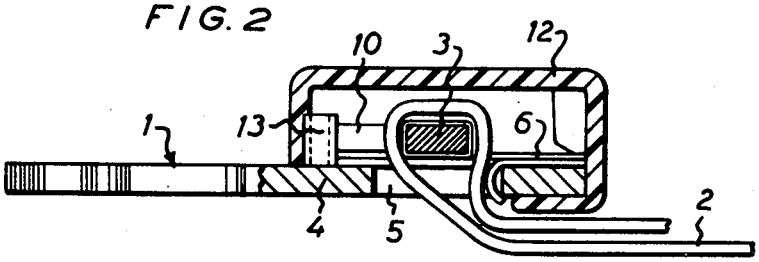
FIG. 2 is a side view, partly in section, of the device cooperating with a belt strap.

The belt strap adjusting device is intended for use with the safety belts of automotive vehicles, aircraft, seacraft etc. More particularly, the device is associated with a buckle member 1 which in the position of use of the safety belt is to be releasably coupled with a coupling means in the vehicle. As shown in the drawing, the buckle member 1 has a locking tongue for insertion into the coupling means which is a releasable buckle having an opening or pocket in which to accommodate the locking tongue.

Figure 4:
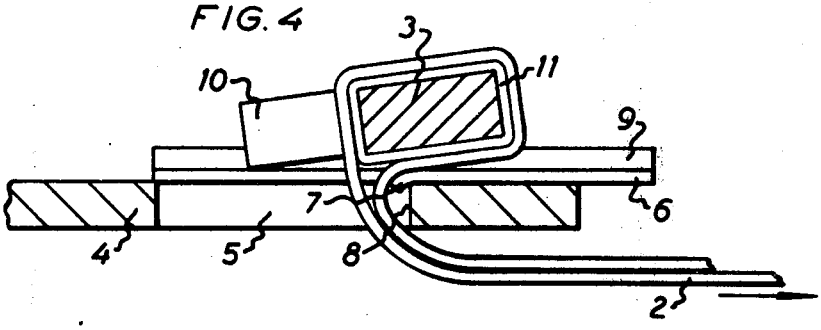
FIG. 4 is a view of the same parts as in FIG. 3, but at an increased loading of the belt strap.

According to the invention, the device for adjusting the strap 2 of the safety belt comprises a bar 3 which is transversely movable with respect to the base plate 4 of said buckle member 1. Said base plate has an opening 5 of at least substantially rectangular shape formed in conjunction with the bar 3. The strap 2 is inserted through the opening 5 and wrapped about an angular portion of the bar 3 to permit the strap 2 to be clamped between the bar 3 and the base plate 4 when the strap 2 is subjected to pull. At a heavy pull at the strap 2 the bar 3 is disposed to be shifted laterally of the opening 5 in the direction of pull, as will appear from FIG. 4.

Between the base plate 4 and the bar 3 the belt strap adjusting device is provided with a thin flat member 6 which is associated with the base plate 4 and adapted, at a heavy pull at the strap 2, to be carried along by the bar 3 in the shifting movement thereof laterally of the opening 5, said flat member 6 lying at said shifting movement between the strap 2 and the base plate 4 so that the strap 2 is protected against abrasion under the heavy load.

The flat member 6 which preferably is a relatively soft and thin metal sheet has a bent edge portion 7 which is adapted to grasp the edge 8 of the opening 5 cooperating with the strap 2. Said bent edge portion 7 is disposed to be straightened when the flat member 6 is carried along by the bar 3 in the shifting movement thereof.

Figure 5:
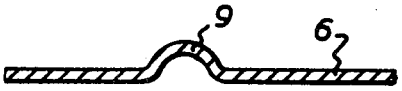
FIG. 5 is a section, on a larger scale, on line V–V in FIG. 1.

At the edges extending in the longitudinal direction of the strap 2, the flat sheet metal member 6 is formed with upwardly directed embossed portions 9 which at a heavy pull at the strap 2 are meant to be deformed by projections 10 arranged at the ends of the bar 3 and extending transversely thereof, whereby the projections 10 will carry the flat sheet metal member 6 along in the shifting movement of the bar 3. As will appear from FIGS. 1 and 5, the embossed portions 9 of the sheet metal member 6 are in the form of ribs which extend throughout the edges of said member 6.

A further reduction of the strap abrasion is realized in that the bar 3 is provided with a protective cover 11, more particularly a protective metal sheet wrapped around the bar 3. Thus, the flat sheet metal member 6 is adapted, in combination with the protective sheet 11, to cooperate with the two sides of the strap 2 at the belt strap adjusting device.

The belt strap adjusting device is located in the casing 12 enclosing the buckle member 1. A leaf spring 13 is interposed between the casing 12 and the projections 10 of the bar 3, said leaf spring preventing an unintentional displacement of the strap 2 when the latter is not under load.

Figure 3:
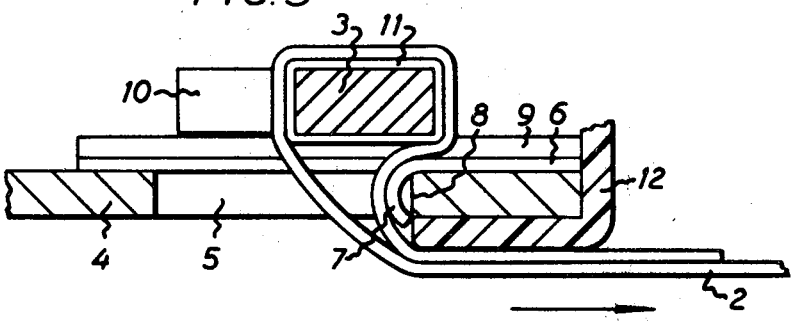
FIG. 3 is a view, on a larger scale, of parts of the device shown in FIG. 2 when the strap is being placed under load.

When the strap 2 is subjected to load, the bar 3 first slides rearwardly in the direction of pull, as will be seen from FIG. 3. With increasing load the pressure exerted on the projections 10 of the bar 3 increases, the projections 10 being forced down into the upwardly directed embossed portions 9 of the relatively soft and thin metal sheet member 6. Since the strap 2 is clamped between the bar 3 and the metal sheet member 6 and the projections 10 have been forced down into the embossed portions 9 of the metal sheet member 6, the latter will be carried along in the direction of pull, the strap 2 being clamped with increasing contact surface as the clamping force increases, the bent edge portion 7 of the metal sheet member 6 being thereby straightened. By reason of the gentle application against the strap 2 under the clamping force and by reason of the increasing contact surface, the adjusting device reduces the risk of the strap being cut under statical and dynamical load.

The strap adjusting device described and illustrated has only one adjusting means. It could, however, be provided with two adjusting means. In that case the buckle 1 is formed with two rectangular openings, each of which is provided with a bar with associated flat sheet metal member. Each bar shall in this instance cooperate with one leaf spring. Of course, both adjusting means need not necessarily be used.

The invention should not be considered as restricted to the embodiment described above and illustrated in the drawing since it can be modified within the spirit and scope of the appended claims.

What I claim and desire to secure by Letters Patent is:

1. A device for adjusting a strap of a safety belt for vehicles and like craft, said device being a latch in the form of a bar which is transversely movable with respect to a base plate formed with an opening which is associated with the bar and through which the strap is passed about the bar for clamping the strap between the bar and the base plate when the strap is subjected to pull, said bar being adapted, at a heavy pull at the strap, to be shifted laterally of the opening in the direction of pull, wherein the belt strap adjusting device has between the base plate and the bar a thin flat member which is associated with the base plate and adapted, at a heavy pull at the strap, to be carried along by the bar when the latter is shifted laterally of the opening, said flat member lying at said shifting movement between the strap and the base plate so that the strap is protected against abrasion under the heavy load, said flat member being a metal sheet having a bent edge portion which is adapted to grasp the edge of the opening cooperating with the strap, said bent edge portion being disposed to be straightened when the flat metal sheet member is carried along by the bar in the shifting movement thereof.

2. A belt strap adjusting device as claimed in claim 1, wherein the flat member is formed, at the edges extending in the longitudinal direction of the strap, with upwardly directed embossed portions, which at a heavy pull at the strap are adapted to be deformed by projections arranged at the ends of the bar, whereby the projections will carry the flat member along in the shifting movement of the bar.

3. A belt strap adjusting device as claimed in claim 2, wherein the upwardly directed embossed portions of the flat member are in the form of ribs which extend throughout the edges of said flat member.

4. A belt strap adjusting device as claimed in claim 1, wherein the flat member is adapted, in combination with a protective cover for the bar, to cooperate with the two sides of the strap.

* * * * *